US009441346B2

(12) United States Patent
Imaizumi et al.

(10) Patent No.: US 9,441,346 B2
(45) Date of Patent: Sep. 13, 2016

(54) WORK VEHICLE AND METHOD OF CONTROLLING WORK VEHICLE

(71) Applicant: Komatsu Ltd., Tokyo (JP)

(72) Inventors: Masaaki Imaizumi, Mooka (JP); Minoru Wada, Mooka (JP)

(73) Assignee: Komatsu Ltd., Tokyo (JP)

( * ) Notice: Subject to any disclaimer, the term of this patent is extended or adjusted under 35 U.S.C. 154(b) by 37 days.

(21) Appl. No.: 14/397,873

(22) PCT Filed: Jul. 12, 2013

(86) PCT No.: PCT/JP2013/069192

§ 371 (c)(1),
(2) Date: Oct. 30, 2014

(87) PCT Pub. No.: WO2015/004809

PCT Pub. Date: Jan. 15, 2015

(65) Prior Publication Data

US 2016/0040391 A1 Feb. 11, 2016

(51) Int. Cl.

| | |
|---|---|
| ***E02F 3/43*** | (2006.01) |
| ***E02F 9/20*** | (2006.01) |
| ***E02F 9/26*** | (2006.01) |
| ***E02F 9/22*** | (2006.01) |
| ***E02F 3/28*** | (2006.01) |

(52) U.S. Cl.

CPC ..... *E02F 9/2029* (2013.01); *E02F 3/283* (2013.01); *E02F 3/431* (2013.01); *E02F 9/2203* (2013.01); *E02F 9/265* (2013.01)

(58) Field of Classification Search

CPC ..... E02F 9/2029; E02F 9/2203; E02F 3/431; E02F 3/283; E02F 3/434

See application file for complete search history.

(56) References Cited

U.S. PATENT DOCUMENTS

| | | | | |
|---|---|---|---|---|
| 5,968,103 | A | 10/1999 | Rocke | |
| 5,974,352 | A | 10/1999 | Shull | |
| 6,246,939 | B1 * | 6/2001 | Nozawa | E02F 3/3411 172/810 |
| 2001/0027366 | A1 | 10/2001 | Ikari | |
| 2004/0117092 | A1 | 6/2004 | Budde | |
| 2006/0129296 | A1 | 6/2006 | Ikari | |

(Continued)

FOREIGN PATENT DOCUMENTS

| | | | |
|---|---|---|---|
| EP | 1666711 | A1 | 6/2006 |
| JP | 10-204927 | A | 8/1998 |

(Continued)

OTHER PUBLICATIONS

International Search Report and Written Opinion mailed Aug. 13, 2013, issued for PCT/JP2013/069192.

(Continued)

*Primary Examiner* — Michael J Zanelli
(74) *Attorney, Agent, or Firm* — Locke Lord LLP

(57) ABSTRACT

A work vehicle includes: a body; a boom which is supported by the body and is turned; a bucket which is supported by a side of the boom opposite to a side of the body and is turned; a boom driving part which turns the boom; a bucket driving part which turns the bucket; a lifting force detector which detects lifting force as force that the boom driving part receives from the boom; and a control device which starts a tilt operation of the bucket when a predetermined condition is established, and ends the tilt operation on the basis of an amount of increase of the lifting force from a time when the tilt operation is started.

5 Claims, 8 Drawing Sheets

(56) References Cited

U.S. PATENT DOCUMENTS

| | | | | |
|---|---|---|---|---|
| 2006/0179690 | A1 | 8/2006 | Ikari | |
| 2006/0184302 | A1 | 8/2006 | Ikari | |
| 2006/0276948 | A1 | 12/2006 | Toda | |
| 2008/0234901 | A1 | 9/2008 | Johnson et al. | |
| 2010/0324788 | A1 | 12/2010 | Toda | |
| 2011/0231070 | A1 | 9/2011 | Toda | |
| 2011/0276238 | A1 | 11/2011 | Toda | |
| 2013/0118160 | A1 | 5/2013 | Toda | |
| 2014/0207346 | A1* | 7/2014 | Filla | E02F 3/431 701/50 |

FOREIGN PATENT DOCUMENTS

| | | | |
|---|---|---|---|
| JP | 2001-271387 | A | 10/2001 |
| JP | 2010-281326 | A | 12/2010 |
| JP | 5228132 | B1 | 7/2013 |

OTHER PUBLICATIONS

Supplementary European Search Report dated Oct. 14, 2015, issued for the corresponding European Patent Application No. 13883343.9.

* cited by examiner

WORK VEHICLE AND METHOD OF CONTROLLING WORK VEHICLE

FIELD

The present invention relates to a work vehicle which particularly performs excavation, and a method of controlling a work vehicle.

BACKGROUND

There exists a work vehicle equipped with a work machine which loads earth and sand or crushed stones to a dump truck or the like. A wheel loader is one example of such a work vehicle. The wheel loader is a vehicle that has a bucket and runs on tires to perform work. There is provided a wheel loader which performs excavation by automatically controlling an operation of the bucket in order to reduce the burden on an operator in the excavation work (refer to Patent Literature 1, for example).

CITATION LIST

Patent Literature

Patent Literature 1: Japanese Laid-open Patent Publication No. 10-204927

SUMMARY

Technical Problem

It is desired for the automatic excavation function included in the wheel loader to be further upgraded in order to allow an inexperienced operator to exert the production efficiency closer to that of an expert.

An object of the present invention is for an operator to realize the production efficiency close to that of an expert regardless of a level of proficiency of the operator when a work machine performs excavation work automatically.

Solution to Problem

The present invention provides a work vehicle comprising: a body; a boom which is supported by the body and is turned; a bucket which is supported by a side of the boom opposite to a side of the body and is turned; a boom driving part which turns the boom; a bucket driving part which turns the bucket; a lifting force detector which detects lifting force as force that the boom driving part receives from the boom; and a control device which starts a tilt operation of the bucket when a predetermined condition is established, and ends the tilt operation on the basis of an amount of increase of the lifting force from a time when the tilt operation is started.

In the present invention, it is preferable that the boom driving part includes a boom hydraulic cylinder, and the lifting force detector is a boom bottom pressure detector which detects a bottom pressure as a pressure on a hydraulic fluid supplied to the boom hydraulic cylinder.

In the present invention, it is preferable that the work vehicle, further comprises a vehicle speed detector which detects a speed at which the work vehicle runs, wherein the control device starts the tilt operation on the basis of at least a detected result from the lifting force detector and a detected result from the vehicle speed detector.

In the present invention, it is preferable that the control device starts an ascending operation of the boom on the basis of the lifting force, the speed at which the work vehicle runs, and an angle of the boom, and ends the ascending operation on the basis of an amount of increase of the lifting force or the angle of the boom from the start of the ascending operation of the boom.

The present invention provides a method of controlling a work vehicle including a body, a boom which is supported by the body and is turned, and a bucket which is supported by a side of the boom opposite to a side of the body and is turned, the method comprising, in controlling an operation of the bucket of the work vehicle: starting a tilt operation of the bucket when a predetermined condition is established; and ending, after the tilt operation is started, the tilt operation on the basis of an amount of increase of the lifting force from a time when the tilt operation is started.

In the present invention, it is preferable that the tilt operation is started on the basis of at least the lifting force and a speed at which the work vehicle runs.

In the present invention, it is preferable that an ascending operation of the boom is started on the basis of the lifting force, the speed at which the work vehicle runs, and an angle of the boom, and the ascending operation is ended on the basis of an amount of increase of the lifting force or the angle of the boom from the start of the ascending operation of the boom.

Advantageous Effects of Invention

According to the present invention, the operator can realize the production efficiency close to that of the expert regardless of the level of proficiency of the operator when the work machine performs the excavation work automatically.

DESCRIPTION OF EMBODIMENTS

Modes for carrying out the present invention (embodiments) will be described in detail with reference to the drawings.

<Wheel Loader>

Figure 1:
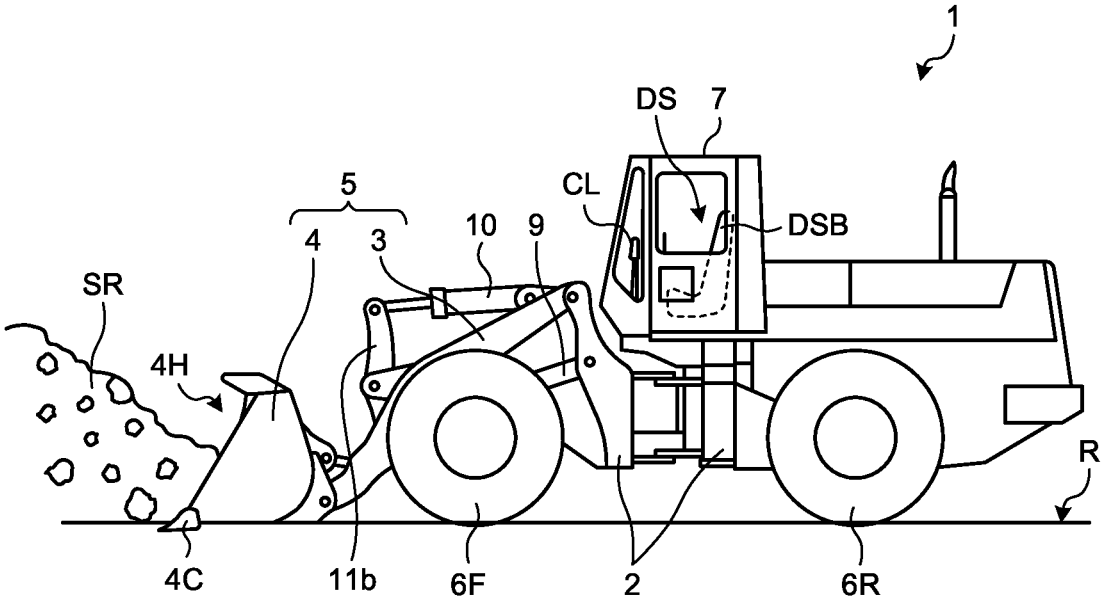
FIG. 1 is a diagram illustrating a work vehicle according to the present embodiment.

FIG. 1 is a diagram illustrating a work vehicle according to the present embodiment. An example of the work vehicle provided in the present embodiment is a wheel loader 1 which loads crushed stones, or earth and sand or rocks produced at the time of excavating the crushed stones onto a dump truck or the like. The wheel loader 1 is a front end loader to which, however, the type of the wheel loader 1 is not to be limited in the present embodiment.

The wheel loader 1 includes a body 2, a work machine 5 including a boom 3 and a bucket 4, a front wheel 6F, a rear wheel 6R, an operator cab 7, a boom cylinder 9, and a bucket cylinder 10. The work machine 5, the front wheel 6F and rear wheel 6R, and the operator cab 7 are mounted to the body 2. A driver seat DS and a control lever CL are provided inside the operator cab 7. A direction directed from a driver seat back DSB of the driver seat DS toward the control lever CL is referred to as a forward direction, whereas a direction directed from the control lever CL toward the driver seat back DSB is referred to as a backward direction. Right and left directions of the wheel loader 1 are based on the forward direction.

The front wheel 6F and the rear wheel 6R are in contact with a road surface R. A side corresponding to the surface of the front wheel 6F and rear wheel 6R in contact with the road surface is referred to as a downward direction, whereas a direction away from the surface of the front wheel 6F and rear wheel 6R in contact with the road surface is referred to as an upward direction. The wheel loader 1 runs when the front wheel 6F and the rear wheel 6R rotate. The wheel loader 1 is steered when the body 2 is bent between the front wheel 6F and the rear wheel 6R.

The work machine 5 is disposed in a front part of the body 2. The boom 3 is supported by a forward side of the body 2 and extends forward. The boom 3 turns while supported by the body 2. The bucket 4 includes an opening 4H and a claw 4C. The claw 4C of the bucket 4 scoops up a load SR such as earth and sand or crushed stones. The load SR scooped up by the claw 4C enters the bucket 4 from the opening 4H. The bucket 4 turns while supported by a side of the boom 3 opposite from a side supported by the body 2.

The boom cylinder 9 is provided between the body 2 and the boom 3. The boom 3 turns, with extension/contraction of the boom cylinder 9, around the center that is a supported portion of the boom on the side supported by the body 2. One end of the bucket cylinder 10 is supported by the body 2 while attached thereto, and another end is attached to one end of a bell crank 11 (shown in greater detail in FIG. 3). Another end of the bell crank 11 is connected to the bucket 4. The bucket 4 turns, with extension/contraction of the bucket cylinder 10, around the center that is a portion supported by the boom 3.

The control lever CL controls the extension/contraction of the boom cylinder 9 and the bucket cylinder 10. At least one of the boom cylinder 9 and the bucket cylinder 10 extends/contracts when an operator on board the operator cab 7 controls the control lever CL. This causes at least one of the boom 3 and the bucket 4 to turn. Accordingly, the boom 3 and the bucket 4 are operated when the operator controls the control lever CL.

<Control System of Work Machine 5>

Figure 2:
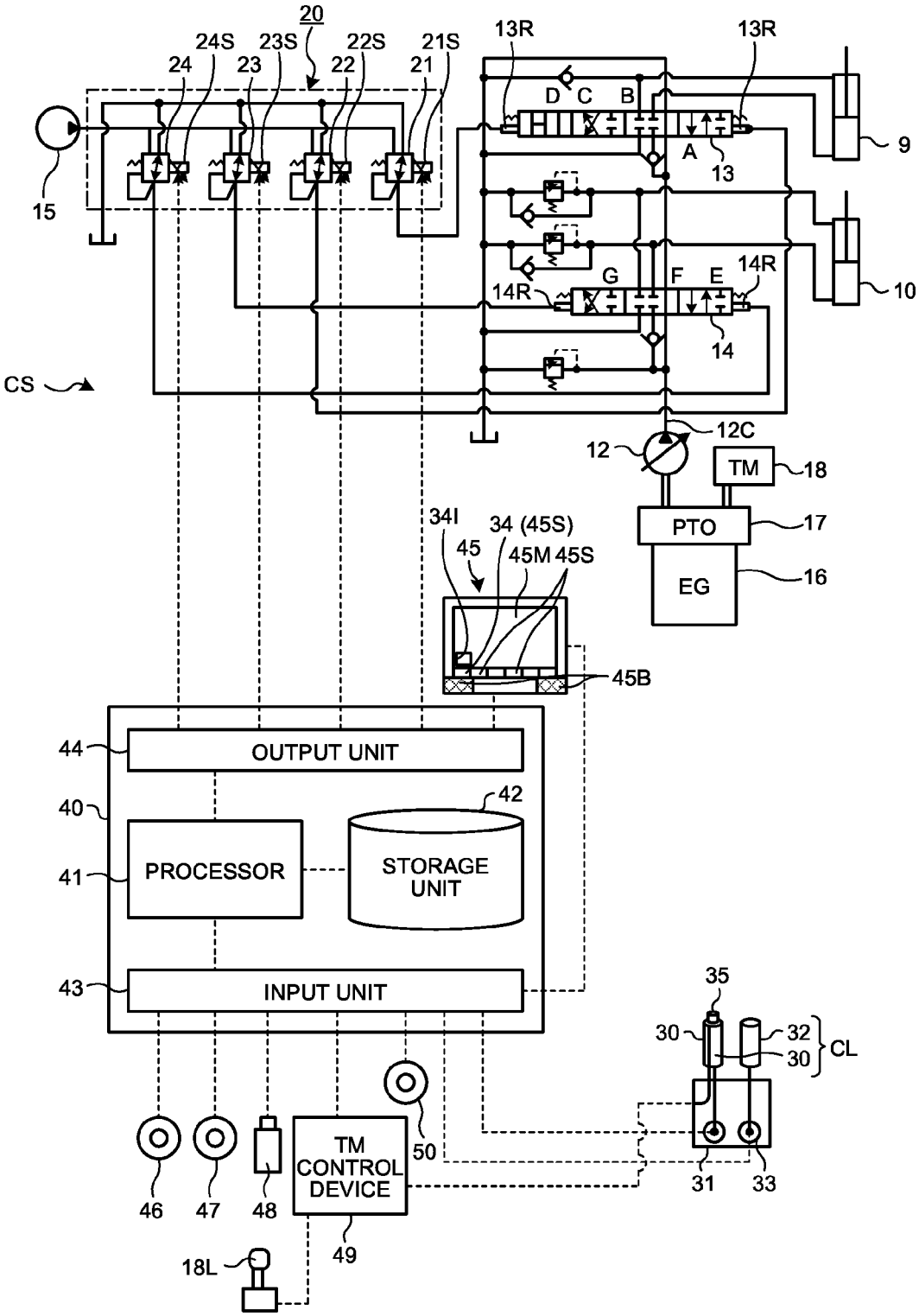
FIG. 2 is a diagram illustrating a control system which controls the operation of a work machine.

FIG. 2 is a diagram illustrating a control system which controls the operation of the work machine. A control system CS controlling the operation of the work machine 5 illustrated in FIG. 1, namely the operation of the boom 3 and the bucket 4, includes a work machine hydraulic pump 12, a boom control valve 13, a bucket control valve 14, a pilot pump 15, a discharge circuit 12C, a solenoid proportional control valve 20, and a control device 40.

The work machine hydraulic pump 12 is driven by an engine (EG) 16 which is mounted in the wheel loader 1 and serves as a power generating source. The output of the engine 16 is input to a PTO (Power Take Off) 17 and thereafter output to the work machine hydraulic pump 12 and a transmission (TM) 18. This structure allows the work machine hydraulic pump 12 to be driven by the engine 16 through the PTO 17 and discharge hydraulic fluid.

The transmission 18 transmits the output of the engine 16 transmitted from the PTO 17 to the front wheel 6F and the rear wheel 6R illustrated in FIG. 1, which are then driven. The wheel loader 1 runs as a result on the front wheel 6F and the rear wheel 6R driven by the output of the engine 16.

A discharge port to which the work machine hydraulic pump 12 discharges the hydraulic fluid is connected to a discharge circuit 12C serving as an oil passage through which the hydraulic fluid passes. The discharge circuit 12C is connected to the boom control valve 13 and the bucket control valve 14. Each of the boom control valve 13 and the bucket control valve 14 is a hydraulic pilot control valve. The boom control valve 13 and the bucket control valve 14 are connected to the boom cylinder 9 and the bucket cylinder 10, respectively. The work machine hydraulic pump 12, the boom control valve 13, the bucket control valve 14, and the discharge circuit 12C together form a tandem hydraulic circuit.

The boom control valve 13 is a four-position switching valve including a position A, a position B, a position C, and a position D. The boom control valve 13 is configured such that the boom 3 comes up at the position A, comes to neutral at the position B, comes down at the position C, and maintains the current position at the position D. The bucket control valve 14 is a three-position switching valve including a position E, a position F, and a position G. The bucket control valve 14 is configured such that the bucket 4 performs a tilt operation at the position E, comes to neutral at the position F, and performs a dump operation at the position G.

The tilt operation of the bucket 4 is an operation in which the opening 4H and the claw 4C of the bucket 4 illustrated in FIG. 1 are tilted by turning toward the operator cab 7. In contrast with the tilt operation, the dump operation of the bucket 4 is an operation in which the opening 4H and the claw 4C of the bucket 4 are tilted by turning away from the operator cab 7.

A pilot pressure receiving part of each of the boom control valve 13 and the bucket control valve 14 is connected to the pilot pump 15 through the solenoid proportional control valve 20. The pilot pump 15 is connected to the PTO 17 and driven by the engine 16. The pilot pump 15 supplies the hydraulic fluid with a predetermined pressure (pilot pressure) through the solenoid proportional control valve 20 to each of a pilot pressure receiving part 13R of the boom control valve 13 and a pilot pressure receiving part 14R of the bucket control valve 14.

The solenoid proportional control valve 20 includes a boom lowering solenoid proportional control valve 21, a boom lifting solenoid proportional control valve 22, a bucket dump solenoid proportional control valve 23, and a bucket tilt solenoid proportional control valve 24. The boom lowering solenoid proportional control valve 21 and the boom lifting solenoid proportional control valve 22 are connected to the corresponding pilot pressure receiving parts 13R and 13R of the boom control valve 13. The bucket dump solenoid proportional control valve 23 and the bucket tilt solenoid proportional control valve 24 are connected to the corresponding pilot pressure receiving parts 14R and 14R of the bucket control valve 14. A command signal from the control device 40 is input to each of a solenoid command part 21S of the boom lowering solenoid proportional control valve 21, a solenoid command part 22S of the boom lifting solenoid proportional control valve 22, a solenoid command part 23S of the bucket dump solenoid proportional control valve 23, and a solenoid command part 24S of the bucket tilt solenoid proportional control valve 24.

The boom lowering solenoid proportional control valve 21, the boom lifting solenoid proportional control valve 22, the boom control valve 13, and the boom cylinder 9 have a function as a boom driving part which turns (moves up/down) the boom 3. The bucket dump solenoid proportional control valve 23, the bucket tilt solenoid proportional control valve 24, the bucket control valve 14, and the bucket cylinder 10 have a function as a bucket driving part which turns the bucket (causes the bucket to perform the tilt operation or the dump operation).

The control device 40 is a computer, for example. The control device 40 includes a processor 41 such as a CPU (Central Processing Unit), a storage unit 42 such as a ROM (Read Only Memory), an input unit 43, and an output unit 44. The processor 41 controls the operation of the work machine 5 by successively executing a variety of commands written in a computer program. The processor 41 is electrically connected to the storage unit 42, the input unit 43, and the output unit 44. This structure allows the processor 41 to read information stored in the storage unit 42, write information to the storage unit 42, receive information from the input unit 43, and output information to the output unit 44.

The storage unit 42 stores the computer program run to control the operation of the work machine 5 as well as information to be used to control the operation of the work machine 5. The storage unit 42 in the present embodiment stores the computer program used to realize a method of controlling a work vehicle according to the present embodiment. The processor 41 realizes the method of controlling a work vehicle according to the present embodiment by reading the computer program from the storage unit 42 and running the program.

Connected to the input unit 43 are a boom angle detection sensor 46, a bucket angle detection sensor 47, a boom cylinder pressure sensor 48 which detects the pressure (bottom pressure) on the hydraulic fluid filling the boom cylinder 9, a TM (Trans Mission) control device 49 which controls the transmission 18, a vehicle speed sensor 50, a first potentiometer 31, a second potentiometer 33, and an input/output device 45. The processor 41 controls the operation of the work machine 5 by acquiring a detected value or a command value from these devices.

The vehicle speed sensor 50 serving as a vehicle speed detector detects the speed (vehicle speed) at which the wheel loader 1 runs. The TM control device 49 shifts a gear position of the transmission 18. In this case, the TM control device 49 controls the gear position on the basis of the vehicle speed acquired from the vehicle speed sensor 50, an accelerator position of the wheel loader 1, and the like.

Connected to the output unit 44 are the solenoid command part 21S of the boom lowering solenoid proportional control valve 21, the solenoid command part 22S of the boom lifting solenoid proportional control valve 22, the solenoid command part 23S of the bucket dump solenoid proportional control valve 23, the solenoid command part 24S of the bucket tilt solenoid proportional control valve 24, and the input/output device 45. The processor 41 gives a command value to operate the boom cylinder 9 to the solenoid command part 21S of the boom lowering solenoid proportional control valve 21 or the solenoid command part 22S of the boom lifting solenoid proportional control valve 22, thereby causing the boom cylinder 9 to extend/contract. The extension/contraction of the boom cylinder 9 causes the boom 3 to move up/down. The processor 41 gives a command value to operate the boom cylinder 9 to the solenoid command part 23S of the bucket dump solenoid proportional control valve 23 or the solenoid command part 24S of the bucket tilt solenoid proportional control valve 24, thereby causing the bucket cylinder 10 to extend/contract. The extension/contraction of the bucket cylinder 10 causes the bucket 4 to perform the tilt operation or the dump operation. This is how the processor 41 controls the operation of the work machine 5, or the boom 3 and the bucket 4.

The input/output device 45 connected to both the input unit 43 and the output unit 44 includes an input unit 45S, a sound producing unit 45B, and a display unit 45M. The input/output device 45 is configured to input a command value to the control device 40 from the input unit 45S, produce a warning sound from the sound producing unit 45B, and display on the display unit 45M a piece of information related to a state of the work machine 5 or control performed thereon. The input unit 45S is a push-button switch, for example. The input unit 45S is operated to switch the information displayed on the display unit 45M or switch an operation mode of the wheel loader 1.

Each input unit 45S is assigned a function to switch the operation mode of the wheel loader 1 or to switch the display on the display unit 45M. FIG. 2 illustrates an example where one of the input units 45S is assigned a function to start automatic excavation as one operation mode. Accordingly, the input unit 45S in the present embodiment is provided as an automatic excavation start switch 34. Once the automatic excavation start switch 34 is operated, the input/output device 45 generates an excavation start signal. The excavation start signal is then input to the control device 40.

Once the excavation start signal is input, the control device 40 controls the wheel loader 1 in an automatic excavation mode. At the same time, the control device 40 displays an icon 34I on the display unit 45M. The icon 34I indicates that the automatic excavation mode is turned ON. Note that the input unit 45S of the input/output device 45 may be built into the display unit 45 as a touch panel so that the automatic excavation start switch 34 is assigned to the icon 34I.

The control lever CL includes a boom control lever 30 and a bucket control lever 32. Attached to the boom control lever 30 is a first potentiometer 31 which detects the control input of the own lever. Attached to the bucket control lever 32 is a second potentiometer 33 which detects the control input of the own lever. A detected signal from each of the first potentiometer 31 and the second potentiometer 33 is input to the input unit 43 of the control device 40.

The boom control lever 30 is provided with a kick-down switch 35. The kick-down switch 35 shifts the gear position of the transmission 18 to a lower gear position while a selector lever 18L of the transmission 18 is not operated.

The kick-down switch 35 is connected to the TM control device 49. After acquiring a command value from the kick-down switch 35, the TM control device 49 shifts the gear position of the transmission 18 to a lower gear than the gear position at the time the command value is acquired. When the gear position at the time the command value is acquired is at a second position, for example, the TM control device 49 shifts the gear position of the transmission 18 to a first position. The kick-down switch 35 in the present embodiment may also serve as the automatic excavation start switch 34.

Figure 3:
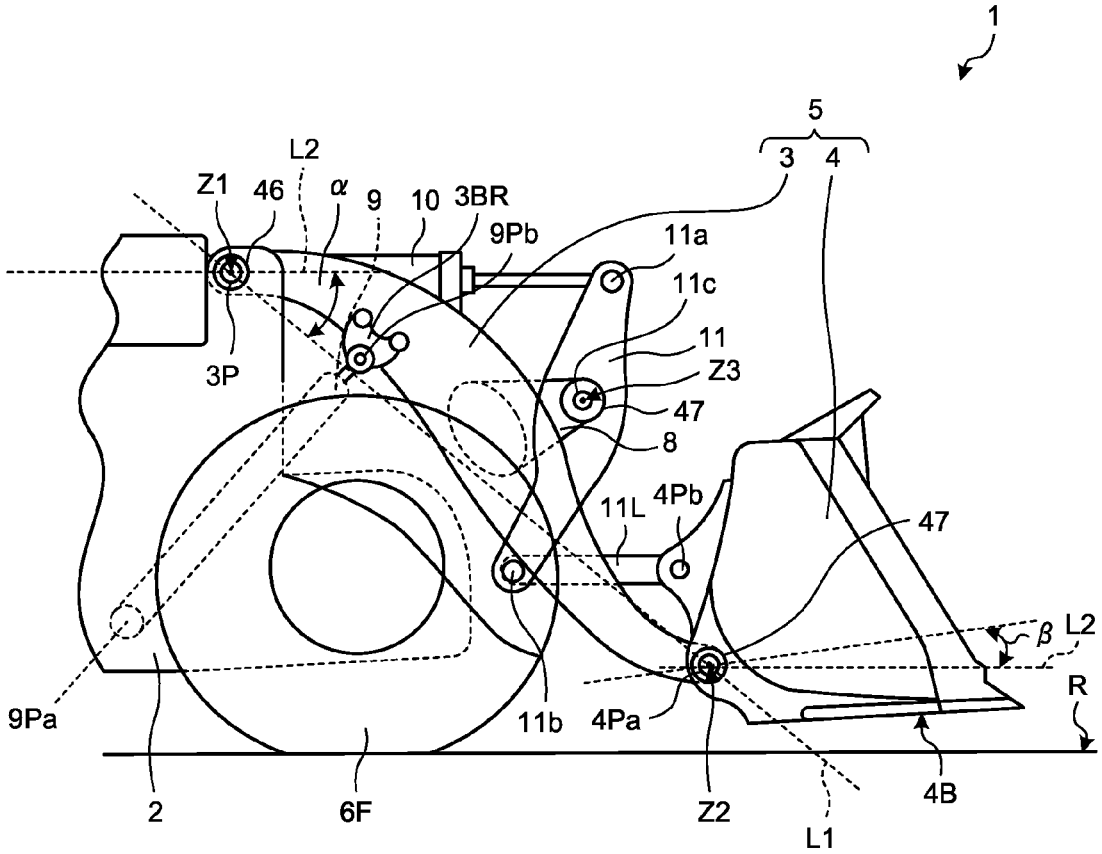
FIG. 3 is a diagram illustrating the work machine.

FIG. 3 is a diagram illustrating the work machine. A first end side of the boom 3 of the work machine 5 is in pin connection with the body 2 by means of a connection pin 3P. A bracket 3BR to which the boom cylinder 9 is attached is attached between two ends of the boom 3. A first end of the boom cylinder 9 is in pin connection with the body 2 by a connection pin 9Pa, while a second end of the boom cylinder is in pin connection with the bracket 3BR by a connection pin 9Pb. This structure allows the boom 3 to turn (move up/down) about a central shaft Z1 of the connection pin 3P as the center when the boom cylinder 9 extends/contracts.

The bucket 4 is in pin connection with a second end side of the boom 3, namely, an end side opposite to the side of the body 2, by a connection pin 4Pa. This structure allows the bucket 4 to turn about a central shaft Z2 of the connection pin 4Pa as the center. A first end of the bucket cylinder 10 is in pin connection with the body 2 by the connection pin 3P, while a second end of the bucket cylinder is in pin connection with a first end of the bell crank 11 by a connection pin 11*a*. A second end of the bell crank 11 is in pin connection with a first end of a connection member 11L by a connection pin 11*b*. A second end of the connection member 11L is in pin connection with the bucket 4 by a connection pin 4Pb.

A support member 8 supporting the bell crank 11 is attached between the two ends of the boom 3. A site between two ends of the bell crank 11 is in pin connection with the support member 8 by a connection pin 11*c*. This structure allows the bell crank 11 to turn about a central shaft Z3 of the connection pin 11*c* as the center. The first end of the bell crank 11 moves toward the body 2 when the bucket cylinder 10 contracts. The second end of the bell crank 11 moves away from the body 2 since the bell crank 11 turns about the central shaft Z3 of the connection pin 11*c*. This causes the bucket 4 to perform the dump operation through the connection member 11L. The first end of the bell crank 11 moves away from the body 2 when the bucket cylinder 10 extends. At this time, the second end of the bell crank 11 moves closer to the body 2 so that the bucket 4 performs the tilt operation through the connection member 11L.

<Angle α of Boom and Angle β of Bucket>

In the work machine 5, an angle α of the boom 3 (hereinafter referred to as a boom angle as appropriate) is the smaller of angles formed by a straight line L1, which connects the central shaft Z1 of the connection pin 3P and the central shaft Z2 of the connection pin 4Pa, and a horizontal line L2 passing the connection pin 3P and parallel to the surface of the front wheel 6F and the rear wheel 6R in contact with the road surface. The boom angle α in the present embodiment takes a negative value when the boom is tilted toward the road surface R from the horizontal line L2. The boom angle α increases when the boom 3 comes up.

An angle β of the bucket 4 (hereinafter referred to as a bucket angle as appropriate) is an angle formed by the road surface R (corresponding to the horizontal line L2 in FIG. 3) and a straight line L3 which passes the central shaft Z2 of the connection pin 4Pa and is parallel to a bottom surface 4B of the bucket 4. The bucket angle β in the present embodiment takes a negative value when the front of the straight line L3 is directed below the central shaft Z2 of the connection pin 4Pa. The bucket angle β increases when the bucket 4 performs the tilt operation.

The boom angle detection sensor 46 detecting the boom angle α is mounted to the site of the connection pin 3P which brings the boom 3 into pin connection with the body 2. The bucket angle detection sensor 47 detecting the bucket angle β is mounted to the site of the connection pin 11*c* to indirectly detect the angle of the bucket 4 through the bell crank 11. The bucket angle detection sensor 47 may instead be mounted to the site of the connection pin 4Pa which connects the boom 3 and the bucket 4. While a potentiometer is used as the boom angle detection sensor 46 and the bucket angle detection sensor 47 in the present embodiment, it is not to be limited to the potentiometer.

The boom angle α detected by the boom angle detection sensor 46 serves as an index indicating the position of the boom 3. The boom angle detection sensor 46 therefore functions as a boom position detector which detects the position of the boom 3. The bucket angle β detected by the bucket angle detection sensor 47 serves as an index indicating the position of the bucket 4. The bucket angle detection sensor 47 therefore functions as a bucket position detector which detects the position of the bucket 4.

When the operator of the wheel loader 1 operates the boom control lever 30 or the bucket control lever 32, the control device 40 acquires from the first potentiometer 31 or the second potentiometer 33 a signal of the control input pertinent to the boom control lever 30 or the bucket control lever 32. The control device 40 thereafter outputs a work machine speed control command corresponding to the signal of the control input to the boom lowering solenoid proportional control valve 21, the boom lifting solenoid proportional control valve 22, the bucket dump solenoid proportional control valve 23, or the bucket tilt solenoid proportional control valve 24.

The boom lowering solenoid proportional control valve 21, the boom lifting solenoid proportional control valve 22, the bucket dump solenoid proportional control valve 23, or the bucket tilt solenoid proportional control valve 24 outputs pilot pressure corresponding to the magnitude of the work machine speed control command to the pilot pressure receiving part of the corresponding boom control valve 13 or bucket control valve 14. The boom cylinder 9 or the bucket cylinder 10 then operates in the corresponding direction at a speed in accordance with the corresponding pilot hydraulic pressure.

<Automatic Excavation>

The work machine 5 of the wheel loader 1 excavates an excavation target when the operator operates at least one of the boom control lever 30 and the bucket control lever 32. In addition, the wheel loader 1 can excavate an excavation target automatically. When the wheel loader 1 is to execute the automatic excavation, the control device 40 inputs the excavation start signal from the automatic excavation start switch 34 to start the automatic excavation. In the automatic excavation, the control device 40 acquires a detected value from each of the boom angle detection sensor 46, the bucket angle detection sensor 47, and the boom cylinder pressure sensor 48. The control device 40 then outputs the work machine speed control command to each of the solenoid command parts 21S, 22S, 23S, and 24S of the solenoid proportional control valve 20 on the basis of the acquired detected value. Accordingly, the control device 40 causes the work machine 5 to perform excavation automatically while controlling the boom angle α and the bucket angle β. When the wheel loader 1 executes the automatic excavation, the control device 40 automatically controls the position of at least one of the boom 3 and the bucket 4 by outputting the command signal to a bucket driving part and a boom driving part on the basis of at least the detected value from the boom angle detection sensor 46 and the detected value from the boom cylinder pressure sensor 48.

When the operator operates the kick-down switch 35 in the automatic excavation, the TM control device 49 shifts the gear position of the transmission 18 to a gear position with a larger gear ratio. This as a result causes the driving power of the wheel loader 1 to increase, thereby improving the excavation efficiency. When the automatic excavation start switch 34 is adapted to also serve as the kick-down switch 35 as described above, the excavation work can be executed easily and efficiently because the gear position of the transmission 18 is shifted to the gear position with the larger gear ratio at the start of the automatic excavation.

The wheel loader 1 having an automatic excavation function can reduce the burden on the operator in the excavation work using the wheel loader 1. In order to enable an inexperienced operator to perform work close to that of an expert, the automatic excavation function of the wheel loader 1 is desired to be further upgraded.

The wheel loader 1 excavates the excavation target by traction. The excavation work is the work where, for example, the work machine 5 goes into the excavation target, and then the operator of the wheel loader 1 controls the bucket 4 and the boom 3 to load earth and sand into the bucket 4 while properly adjusting the traction of the wheel loader 1. In the excavation work using the wheel loader 1, it is thought that an experienced operator grasps an excavation state through the operation and behavior of the wheel loader 1 and allows the wheel loader 1 to exert proper traction according to the excavation state by controlling the bucket 4 and the boom 3 at a proper timing.

The inventors have examined in detail the operation as well as a state of each component of the wheel loader 1 at the time of excavation. The inventors have found out as a result that the lifting force of the boom 3 is in correlation with the traction of the wheel loader 1. The inventors have then found out that it is effective, for the improvement of the production efficiency of the wheel loader 1, to place emphasis on determining a timing at which the bucket 4 performs the tilt operation and at which the boom 3 performs a lift, especially a timing to end the tilt operation, on the basis of the lifting force of the boom 3. In the present embodiment, the lifting force refers to the force that a boom driving part, the boom cylinder 9 to be specific, receives from the boom 3. The production efficiency corresponds to the excavation amount excavated by the wheel loader 1 per unit time.

The wheel loader 1 in the present embodiment ends the tilt operation of the bucket 4 on the basis of the lifting force in the automatic excavation. Specifically, when the automatic excavation is to be executed by the wheel loader 1, the control device 40 starts the tilt operation of the bucket 4 when a predetermined condition is established and ends the tilt operation on the basis of the amount of increase in the lifting force measured from the time when the tilt operation is started. This allows the wheel loader 1 to end the tilt operation of the bucket 4 at the proper timing in the automatic excavation, whereby the production efficiency of the wheel loader 1 can be improved to realize the production efficiency close to that of an expert regardless of a level of proficiency of the operator.

<Method of Controlling Work Vehicle>

Figure 4:
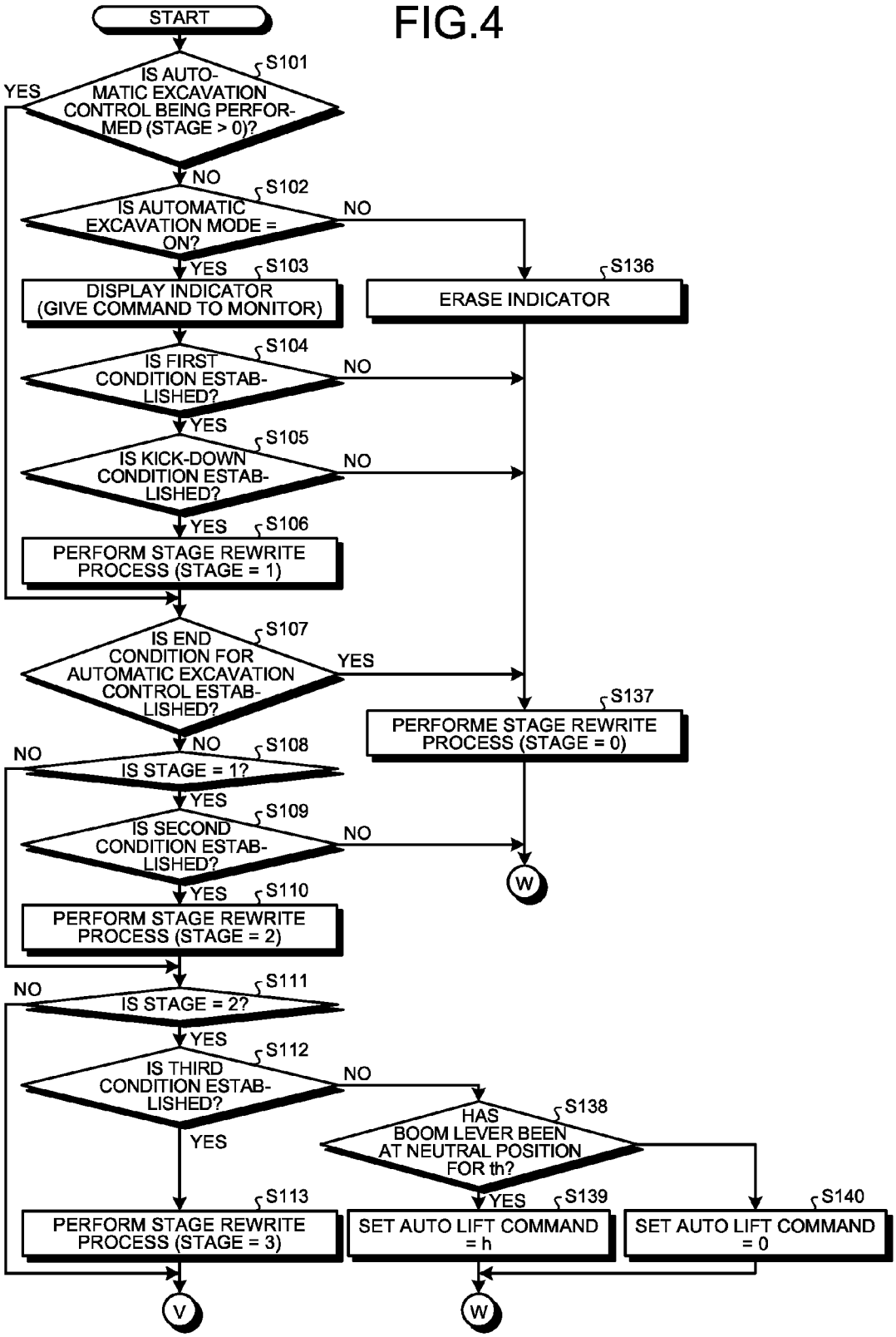
FIG. 4 is a flowchart illustrating an example of processes performed in a method of controlling a work vehicle according to the present embodiment.
Figure 5:
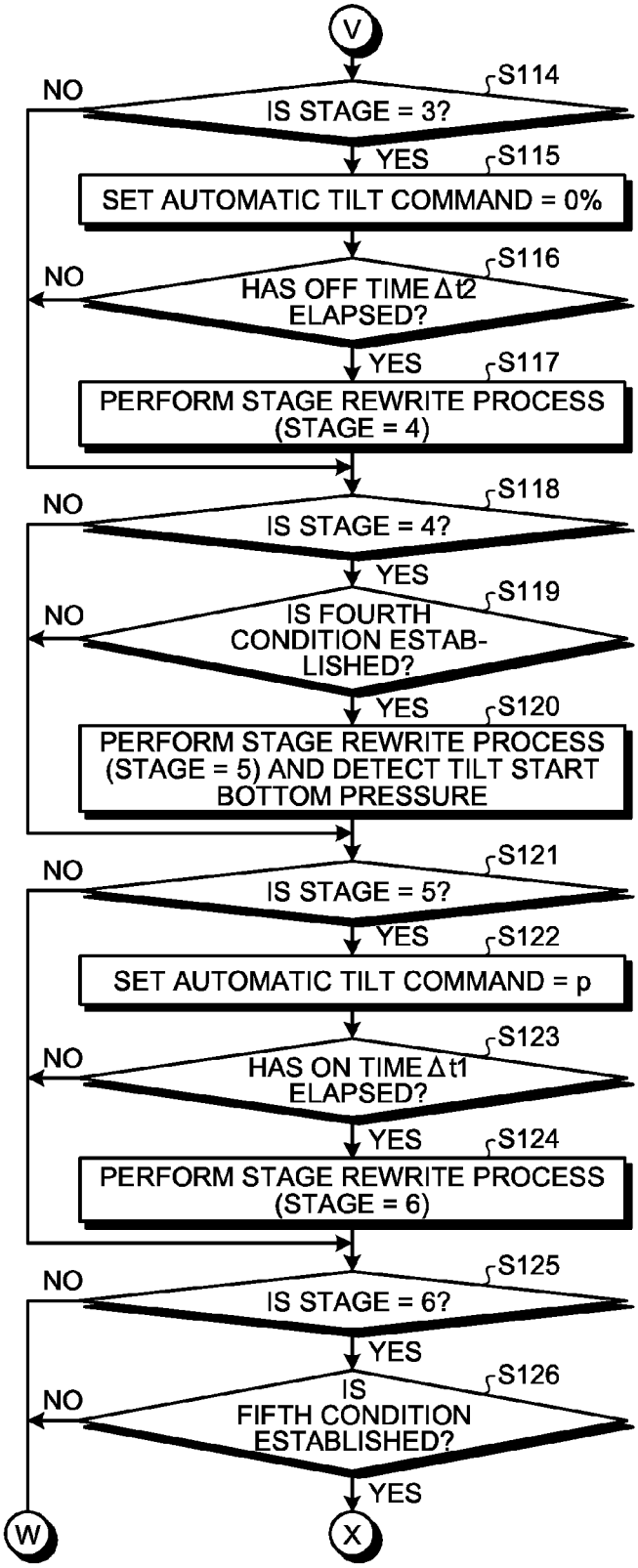
FIG. 5 is a flowchart illustrating an example of processes performed in the method of controlling a work vehicle according to the present embodiment.
Figure 6:
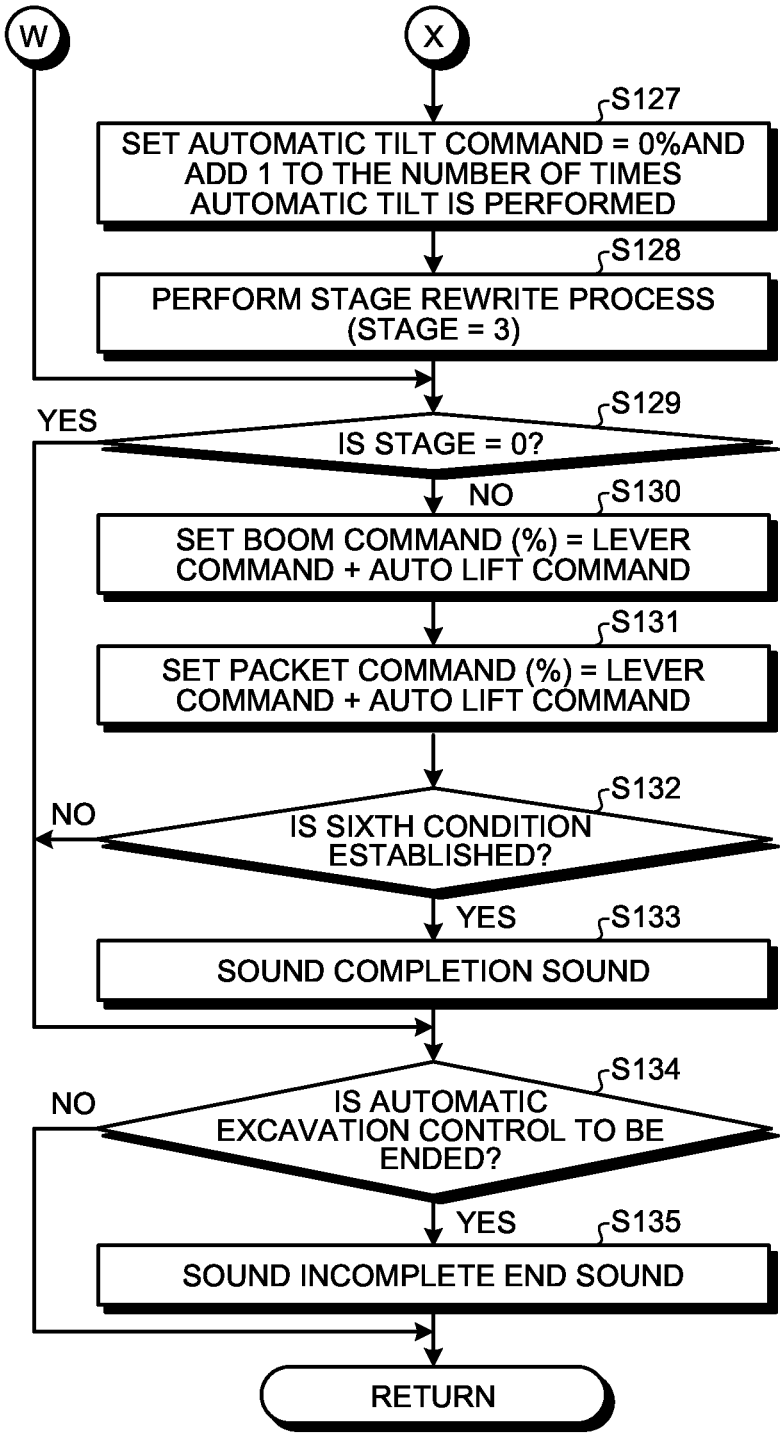
FIG. 6 is a flowchart illustrating an example of processes performed in the method of controlling a work vehicle according to the present embodiment.
Figure 7:
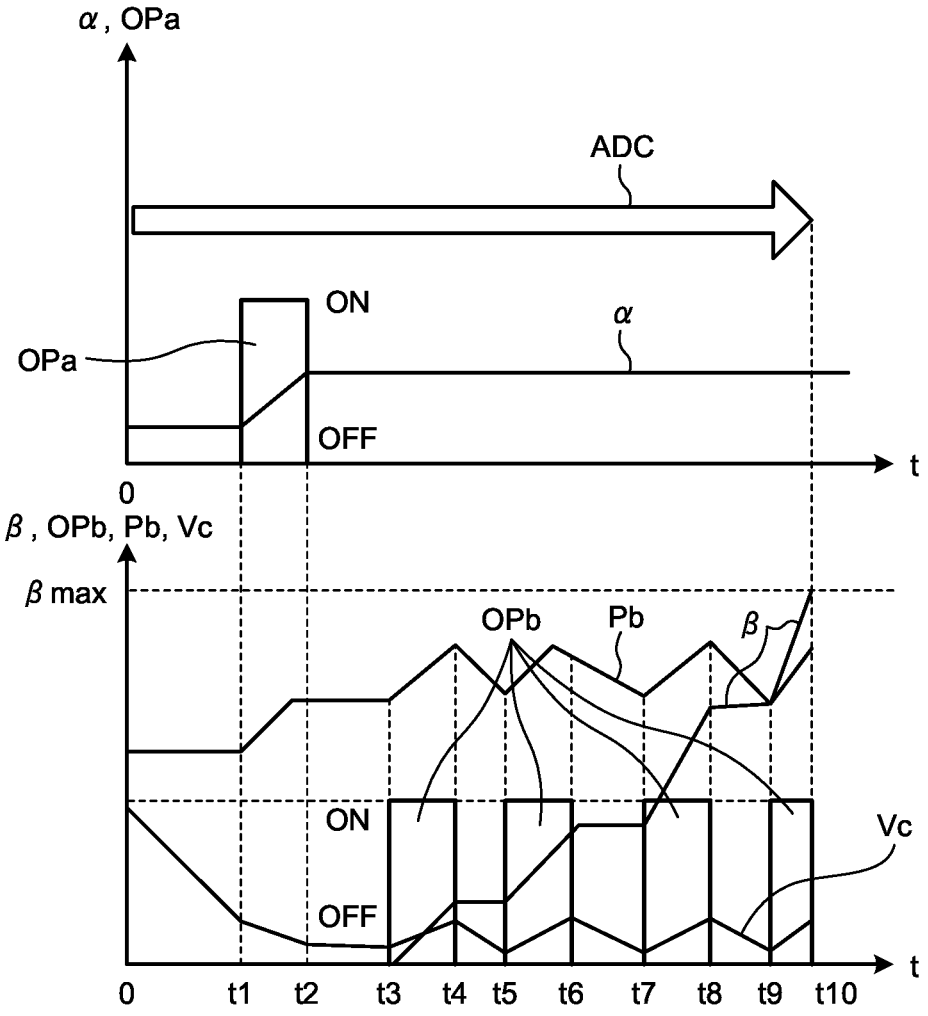
FIG. 7 is a timing chart used in the method of controlling a work vehicle according to the present embodiment.
Figure 8:
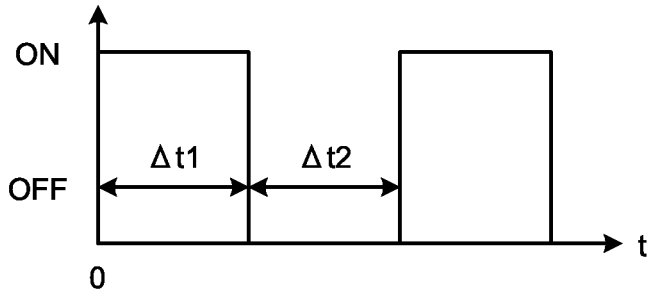
FIG. 8 is a diagram illustrating a time (ON time) when a bucket tilt solenoid proportional control valve is opened and a time (OFF time) when such valve is closed at the time of automatic excavation.

FIGS. 4 to 6 are flowcharts illustrating an example of processes performed in the method of controlling a work vehicle according to the present embodiment. FIG. 7 is a timing chart used in the method of controlling a work vehicle according to the present embodiment. FIG. 8 is a diagram illustrating a time (ON time) when the bucket tilt solenoid proportional control valve is opened and a time (OFF time) when such valve is closed at the time of the automatic excavation. In the upper timing chart illustrated in FIG. 7, a vertical axis represents the boom angle $\alpha$ and an automatic lift command OPa, while a horizontal axis represents time t. In the lower timing chart illustrated in FIG. 7, a vertical axis represents the bucket angle $\beta$, an automatic tilt command OPb, bottom pressure Pb, and vehicle speed Vc, while a horizontal axis represents time t. An ON state and an OFF state of each of the automatic lift command OPa and the automatic tilt command OPb are illustrated in FIG. 7. The method of controlling a work vehicle according to the present embodiment is a method of controlling the wheel loader 1, particularly a method of controlling the work machine 5, which performs the excavation work automatically.

A state of a process in the automatic excavation control performed in the present embodiment is distinguished by the concept of a stage. The present embodiment includes stages zero to six. The stage zero is a state where the automatic excavation control is complete, the stage one is a stage where a start condition for the automatic excavation control is determined, the stage two is a state where it is being determined whether to end the automatic lift while the automatic lift is performed, the stage three is a stage where it is on stand-by to perform the automatic tilt, the stage four is a stage where an automatic tilt start condition is being determined, the stage five is a stage where the automatic tilt operation is being performed, and the stage six is a stage where an automatic tilt operation end condition is being determined.

In step S101, the processor 41 of the control device 40 illustrated in FIG. 2 determines whether or not the wheel loader 1 is in the middle of performing the automatic excavation control. The processor 41 determines that the automatic excavation control is being performed when the stage is higher than the stage zero. The processor 41 determines that the automatic excavation control is not being performed when it is in the stage zero. When it is in the stage zero, or when the automatic excavation control is not being performed (step S101: No), the processor 41 determines whether or not the automatic excavation mode is turned ON, or whether or not the automatic excavation mode is activated. The processor 41 determines that the automatic excavation mode is turned ON when detecting that the automatic excavation start switch 34 illustrated in FIG. 2 is operated, for example.

When the automatic excavation mode is turned ON (step S102: Yes), the processor 41 in step S103 displays on the display unit 45M of the input/output device 45 illustrated in FIG. 2 that the automatic excavation mode is turned ON, for example. The process then proceeds to step S104 where the processor 41 determines whether or not a first condition is established. The first condition refers to a case where the wheel loader 1 is moving forward and the bucket 4 is in touch with the road. The processor 41 determines that the wheel loader 1 is moving forward when detecting a forward signal from the selector lever 18L or the TM control device 49 illustrated in FIG. 2. The processor 41 also determines that the bucket 4 is in touch with the road when a detected value from the boom angle detection sensor 46 illustrated in FIG. 2 is smaller than a determination value "a". The determination value "a" is not limited to a certain value but set to −30 degrees in the present embodiment.

When the first condition is established (step S104: Yes), the processor 41 in step S105 determines whether or not a kick-down condition is established. The kick-down condition is established when a transmission mode of the transmission 18 illustrated in FIG. 2 is in an automatic transmission mode and a kick-down command is input to the TM control device 49, or when the gear position of the transmission 18 in the first position and the kick-down switch 35 is turned ON. When the kick-down condition is established (step S105: Yes), the conditions in step S102, step S104, and step S105 are all satisfied so that the automatic excavation control is started. In the timing chart illustrated in FIG. 7, the automatic excavation control is started at time t=0.

In step S106, the processor 41 executes a rewrite process of the stage. As the automatic excavation control is executed from step S106 onward, the processor 41 in step S106 rewrites the stage to the stage one and transitions the state of the automatic excavation control to the one where an automatic lift condition is being determined. The automatic excavation control is started at time t=0 in the timing chart illustrated in FIG. 7. The automatic excavation control is performed during a period indicated by an arrow ADC in FIG. 7.

The processor 41 thereafter proceeds to step S107 to determine whether or not the end condition for the automatic excavation control is established. The end condition for the automatic excavation control is established in the present embodiment when any one of the following (1) to (8) is established:

(1) The automatic excavation mode is turned OFF (the automatic excavation mode is not activated);

(2) Something other than the forward signal is detected;

(3) A predetermined time has elapsed (0.5 seconds in the present embodiment) since a tilt end of the bucket 4 was detected;

(4) The boom angle α equals a predetermined angle or larger (0 degree or larger in the present embodiment);

(5) The work machine 5 is locked;

(6) A problem is found in the sensor or the control system CS of the work machine 5;

(7) The control input of the boom control lever 30 is larger than a predetermined amount in a direction in which the boom 3 is moved down; and (8) The control input of the bucket control lever 32 is larger than a predetermined amount in a direction in which the bucket 4 performs the dump operation.

When the end condition for the automatic excavation control is not established (step S107: No), the processor 41 in step S108 determines whether or not the stage is in the stage one. The processor 41 determines whether or not a second condition is established in step S109 when the stage is in the stage one (step S108: Yes). The second condition is a condition to be met to start the automatic lift (ascent) of the boom 3. In the present embodiment, the second condition is established when a state in which the bottom pressure Pb is larger than a determination value "b" lasts for a predetermined time "ta" or longer, the boom angle α is smaller than a determination value "c", and a state in which the vehicle speed Vc is lower than a determination value "d" lasts for a predetermined time "tb" or longer.

The processor 41 starts the ascending operation of the boom 3 on the basis of the lifting force, namely, the bottom pressure Pb, the vehicle speed Vc, and the boom angle α, as described above. As a result, in the present embodiment, the bottom pressure Pb is used to determine the start condition for the boom 3 to be subjected to the automatic lift so that one can properly determine the timing at which the wheel loader 1 can exert the traction.

In the present embodiment, the determination value "b" and the determination value "c" are set to 6 MPa and −10 degrees, respectively, but are not to be limited to these values. The predetermined times "ta" and "tb" are both set to 0.1 seconds in the present embodiment but are not to be limited to such value. The predetermined times "ta" and "tb" are identical in the present embodiment but may differ from each other.

When the second condition is established (step S109: Yes), the processor 41 executes the automatic lift of the boom 3 and the rewrite process of the stage in step S110. The automatic lift is started at time t=T1 in the timing chart illustrated in FIG. 7. In executing the automatic lift, the processor 41 gives an automatic lift command to the solenoid command part 22S of the boom lifting solenoid proportional control valve 22 illustrated in FIG. 2. This causes the boom cylinder 9 to extend and the boom 3 to come up. The automatic lift command is given in the form of a percentage where 0% corresponds to the boom lifting solenoid proportional control valve 22 being fully closed, and 100% corresponds to the valve being fully open. A reference numeral OPa in FIG. 7 corresponds to the automatic lift command. When the second condition is established, the processor 41 rewrites the stage to the stage two and transitions the state of the automatic excavation control to the one where it is being determined whether to end the automatic lift while the automatic lift is being performed. Next, in step S111, the processor 41 determines whether or not the stage is in the stage two.

When the stage is in the stage two (step S111: Yes), the processor 41 in step S112 determines whether or not a third condition is established. The third condition is a condition to be met to end the automatic lift of the boom 3. In the present embodiment, the third condition is established when the amount of increase of the boom angle α from the time the boom 3 starts the automatic lift is larger than a determination value "f", or when a state in which the bottom pressure Pb is larger than a determination value "g" lasts for a predetermined time "tc" or longer. The determination value "f" and the determination value "g" in the present embodiment are set to 3 degrees and 30 MPa, respectively, but are not to be limited to these values. The predetermined time "tc" in the present embodiment is set to 0.1 seconds but is not to be limited thereto.

The present embodiment is adapted to end the ascending operation of the boom 3 on the basis of the lifting force, namely, the amount of increase of the bottom pressure Pb or the boom angle α, from the start of the ascending operation of the boom 3. The processor 41 determines the end condition for the automatic lift of the boom 3 by using the amount of increase of the bottom pressure Pb or the boom angle α, as described above, thereby ending the automatic lift at the time the traction generated by the wheel loader 1 reaches an appropriate level and shifting the operation to the automatic tilt operation.

When the third condition is established (step S112: Yes), the processor 41 ends the automatic lift of the boom 3 and executes the rewrite process of the stage in step S113. The automatic lift ends at t=t2 in the timing chart illustrated in FIG. 7. As one can see from FIG. 7, the boom angle α is increased after the end of the automatic lift compared to the angle before the automatic lift is started. Moreover, as one can see from FIG. 7, the bottom pressure Pb rises while the automatic lift is performed. When the third condition is established, the processor 41 rewrites the stage to the stage three and transitions the state of the automatic excavation control to the one where it is on stand-by to perform the automatic tilt operation. Next, in step S114 illustrated in FIG. 5, the processor 41 determines whether or not the stage is in the stage three. Note that "v" in FIG. 4 corresponds to "v" in FIG. 5.

When the stage is in the stage three (step S114: Yes), the processor 41 in step S115 sets an automatic tilt command to 0% and outputs the command to the solenoid command part 24S of the bucket tilt solenoid proportional control valve 24. The automatic tilt command is a command issued to open the bucket tilt solenoid proportional control valve 24 in a predetermined degree. The automatic tilt command is given in the form of a percentage where 0% corresponds to the bucket tilt solenoid proportional control valve 24 being fully closed, and 100% corresponds to the valve being fully open.

As illustrated in a valve opening/closing pattern in FIG. 8, the automatic tilt command is a combination of an ON time Δt1 during which the bucket tilt solenoid proportional control valve 24 is opened and an OFF time Δt2 during which the bucket tilt solenoid proportional control valve 24 is closed. The ON time Δt1 and the OFF time t2 are set beforehand according to the number of times the automatic tilt is performed and stored as an automatic tilt period table in the storage unit 42 of the control device 40 illustrated in FIG. 2.

Proceeding to step S116, the processor 41 reads from the automatic tilt period table the OFF time Δt2 corresponding to the number of times the automatic tilt operation is to be executed. The processor 41 then determines whether or not the OFF time Δt2 has elapsed. By performing such process, the processor 41 in the present embodiment does not execute the automatic tilt operation until a predetermined time elapses after the third condition to end the automatic lift of the boom 3 is established.

Once the OFF time Δt2 has elapsed (step S116: Yes), the processor 41 in step S117 rewrites the stage to the stage four and transitions the state of the automatic excavation control to the one where the start condition for the automatic tilt operation is being determined. When the OFF time Δt2 has not yet elapsed (step S116: No), the processor 41 stands by until the OFF time Δt2 has elapsed.

In step S118, the processor 41 determines whether or not the stage is in the stage four. When the stage is in the stage four (step S118: Yes), the processor 41 determines in step S119 whether or not a fourth condition is established. The fourth condition is a condition to be met to start the automatic tilt operation. In the present embodiment, the fourth condition is established when a state in which the bottom pressure Pb is larger than a determination value "j" lasts for a predetermined time "td", and when a state in which the vehicle speed Vc is slower than a determination value "k" lasts for a predetermined time "te". The determination value "j" and the determination value "k" in the present embodiment are set to 16 MPa and 2 km per hour, respectively, but are not to be limited to these values. The predetermined times "td" and "te" in the present embodiment are both set to 0.1 seconds but are not to be limited thereto. Moreover, the predetermined times "td" and "te" are identical in the present embodiment but may differ from each other.

When the fourth condition is established (step S119: Yes), the processor 41 in step S120 rewrites the stage to the stage five and transitions the state of the automatic excavation control to the one where the automatic tilt operation is being performed. Moreover, in step S120, the processor 41 acquires the bottom pressure Pb from the boom cylinder pressure sensor 48 illustrated in FIG. 2. The bottom pressure Pb is the pressure at the start of the automatic tilt operation and corresponds to the lifting force generated at the start of the automatic tilt operation.

As described above, the processor 41 starts the automatic tilt operation of the bucket 4 on the basis of the detected result from a lifting force detector, namely, the bottom pressure Pb that is the detected result from the boom cylinder pressure sensor 48 and the vehicle speed Vc that is the detected result from the vehicle speed sensor 50. Therefore, the processor 41 can relatively easily and reliably know a timing at which the traction of the wheel loader 1 becomes saturated by using the bottom pressure Pb and the vehicle speed Vc corresponding to the lifting force that has high correlation with the traction of the wheel loader 1. As a result, the processor 41 can cause the bucket 4 to perform the automatic tilt operation at a proper timing and thus realize efficient loading work. The productivity of the wheel loader 1 is improved as a result.

Next in step S121, the processor 41 determines whether or not the stage is in the stage five. When the stage is in the stage five (step S121: Yes), the processor 41 in step S122 sets the automatic tilt command to "p" and outputs the command to the solenoid command part 24S of the bucket tilt solenoid proportional control valve 24. The "p" equals 100% in the present embodiment. The bucket 4 starts the automatic tilt operation once the automatic tilt command is output to the solenoid command part 24S of the bucket tilt solenoid proportional control valve 24. The automatic tilt operation is started at time t=t3 in the timing chart illustrated in FIG. 7. A reference numeral OPb in FIG. 7 corresponds to the automatic tilt command.

Proceeding to step S123, the processor 41 reads from the automatic tilt period table the ON time Δt1 corresponding to the number of times the automatic tilt operation is to be executed. The processor 41 then determines whether or not the ON time Δt1 has elapsed. Once the ON time Δt1 has elapsed (step S123: Yes), the processor 41 in step S124 rewrites the stage to the stage six and transitions the state of the automatic excavation control to the one where the end condition for the automatic tilt operation is being determined.

Now proceeding to step S125, the processor 41 determines whether or not the stage is in the stage six. When the stage is in the stage six (step S125: Yes), the processor 41 determines in step S126 whether or not a fifth condition is established. The fifth condition is a condition to be met to end the automatic tilt operation. In the present embodiment, the fifth condition is established when the bottom pressure Pb is higher than a determination value "j" and an amount of increase ΔPb of the bottom pressure Pb from the time the bucket 4 starts the automatic tilt operation is larger than a determination value "m", or when a state in which the vehicle speed Vc is faster than a determination value "n" lasts for a predetermined time "tf" or longer. The determination value "m" and the determination value "k" in the present embodiment are set to 4 MPa and 2 km per hour, respectively, but are not to be limited to these values. The predetermined time "tf" in the present embodiment is set to 0.1 seconds but is not to be limited thereto.

When the fifth condition is established (step S126: Yes), the processor 41 sets the automatic tilt command to 0% and outputs the command to the solenoid command part 24S of the bucket tilt solenoid proportional control valve 24 in step S127 illustrated in FIG. 6. In step S128, the processor 41 adds 1 to the current number of times the automatic tilt operation is performed. The operation of the bucket cylinder 10 stops once the automatic tilt command of 0% is given to the solenoid command part 24S of the bucket tilt solenoid proportional control valve 24, thereby ending the automatic tilt operation of the bucket 4. The automatic tilt operation ends at time t=t4 in the timing chart illustrated in FIG. 7. The current number of times the automatic tilt operation is performed is increased by 1 in step S128 because the automatic tilt operation is executed in step S122. Note that "x" in FIG. 4 corresponds to "x" in FIG. 5.

As described above, the processor 41 ends the tilt operation on the basis of the amount of increase ΔPb of the bottom pressure Pb from the time the bucket 4 starts the tilt operation. In other words, the processor 41 ends the tilt operation on the basis of the bottom pressure Pb corresponding to the lifting force that has high correlation with the traction of the wheel loader 1 and shifts the operation to the excavation operation using the traction of the wheel loader 1. This allows the work machine 5 of the wheel loader 1 to shift from the tilt operation to the excavation operation at a proper timing so that the efficient loading work can be realized. The productivity of the wheel loader 1 is improved as a result.

Moreover, in the present embodiment, the processor 41 determines the timing to end the tilt operation by using the vehicle speed Vc in addition to the amount of increase ΔPb of the bottom pressure Pb. The vehicle speed Vc is correlated with the traction of the wheel loader 1 as well. The processor 41 can therefore allow the work machine 5 of the wheel loader 1 to shift from the tilt operation to the excavation operation at the proper timing by using the vehicle speed Vc and realize more efficient loading work.

Next, in step S128, the processor 41 rewrites the stage to the stage three and transitions the state of the automatic excavation control to the one where it is on stand-by to perform the automatic tilt operation. In step S129, the processor 41 determines whether or not the stage is in the stage zero. When the stage is not in the stage zero (step S129: No), the processor 41 in step S130 sets, as a boom command, a value obtained by adding a current lever command and the current automatic lift command. In step S131, the processor 41 sets a value obtained by adding the current lever command and the current automatic tilt command as a bucket command. Steps S130 and S131 may be executed in any order in the present embodiment. The lever command is a command issued to determine the degree of opening of the boom control valve 13 or the bucket control valve 14 calculated from the control input of the boom control lever 30 or the bucket control lever 32.

In step S132, the processor 41 determines whether or not a sixth condition is established. The sixth condition is established when a predetermined time "tg" has elapsed after the tilt end is detected in the middle of the automatic excavation control. The sixth condition is a condition to indicate that the excavation performed by means of the automatic excavation control is completed. The predetermined time "tg" in the present embodiment is set to 0.5 seconds but is not to be limited thereto. The tilt end refers to a state where the bucket cylinder 10 is extended to the utmost and the bucket 4 cannot perform any more of the tilt operation. The tilt end is detected by the bucket angle detection sensor 47, for example. The bucket 4 reaches the tilt end at t=t10 in the timing chart illustrated in FIG. 7.

When the sixth condition is established (step S132: Yes), the processor 41 in step S133 causes the sound producing unit 45B of the input/output device 45 illustrated in FIG. 2 to produce a sound indicating that the excavation performed by the automatic excavation control is completed, for example. This sound produced from the sound producing unit 45B can let the operator of the wheel loader 1 know that the excavation performed by the automatic excavation control is now complete.

Next, in step S134, the processor 41 determines whether or not to end the automatic excavation control. The processor 41 gives priority to the operation by the operator and ends the automatic excavation control when, for example, the operator of the wheel loader 1 turns OFF the automatic excavation mode, namely cancels the automatic excavation mode, or when the operator operates the boom control lever 30 or the bucket control lever 32 by a predetermined amount.

The processor 41 does not end the automatic excavation control (step S134: No) when the operator does not perform the aforementioned operation, for example. In this case, the processor 41 returns to the start and executes the process in step S101 and onward. The processor 41 ends the automatic excavation control (step S134: Yes) when the operator performs the aforementioned operation, for example. In this case, the processor 41 rewrites any stage to the stage zero. After that, in step S135, the processor 41 causes the sound producing unit 45B of the input/output device 45 illustrated in FIG. 2 to produce a sound indicating that the automatic excavation control is ended in an incomplete state, for example. This sound produced from the sound producing unit 45B can let the operator of the wheel loader 1 know that the automatic excavation control is ended in midstream due to his own operation or the like.

The sound produced when the excavation by the automatic excavation control is completed and the sound produced when the automatic excavation control is ended in the incomplete state are made different in the present embodiment. This allows the operator to distinguish between the case where the excavation by the automatic excavation control is completed and the case where the automatic excavation control is ended in the incomplete state. Once step S135 is completed, the processor 41 returns to the start and executes the process in step S101 and onward.

Next, there will be described a case where the determination is affirmative, or it is determined Yes, in step S101. When the stage is not in the stage zero in step S101, namely, the automatic excavation control is being performed (step S101: Yes), the processor 41 need not determine whether or not the automatic excavation control is being performed. The processor 41 therefore proceeds to step S107 and executes the process in step S107 and onward.

Next, there will be described a case where the determination is negative, or it is determined No, in step S102. When the automatic excavation mode is turned OFF in step S102 (step S102: No), the processor 41 in step S136 erases, from the display unit 45M of the input/output device 45 illustrated in FIG. 2, the icon 34I as an indicator indicating that the automatic excavation mode is turned ON, for example. This makes it easier for the operator of the wheel loader 1 to recognize that the automatic excavation mode is turned OFF.

The processor 41 proceeds to step S137 after executing the process in step S136. The processor 41 ends the automatic excavation control in step S137. The processor 41 rewrites the stage to the stage zero when ending the automatic excavation control. The processor 41 thereafter resets the automatic lift command, the automatic tilt command, and the number of times the automatic tilt operation is executed. In the present embodiment, the processor 41 resets the automatic lift command to 0%, the automatic tilt command to 0%, and the number of times the automatic tilt operation is executed to 0 time. After completing step S136, the processor 41 proceeds to step S129 and executes the process in step S129 and onward. Note that "w" in FIG. 4 corresponds to "w" in FIG. 6.

Next, there will be described a case where the determination is negative, or it is determined No, in step S104. The first condition is not established in this case (step S104: No) so that the automatic excavation control is not executed. The processor 41 executes the process in step S137 and onward as a result. Next, there will be described a case where the determination is negative, or it is determined No, in step S105. The kick-down condition is not established in this case (step S105: No) so that the automatic excavation control is not executed. The processor 41 executes the process in step S137 and onward as a result.

Next, there will be described a case where the determination is affirmative, or it is determined Yes, in step S107. In this case, the condition to end the automatic excavation control is established (step S107: Yes) so that the automatic excavation control is not executed from this point on. The processor 41 executes the process in step S137 and onward as a result. When the sixth condition is established in step S132 and the automatic excavation mode is not cancelled by the operator, for example, the processor 41 performs the process in step S133 after step S132, followed by a No determination in step S134 and a Yes determination in step S101, thereby reaching step S107. The sixth condition determined in step S132 includes that the aforementioned end condition (3) for the automatic excavation mode is established. Therefore, the processor 41 determines in step S107 that the condition to end the automatic excavation control is established (step S107: Yes), and executes the process in step S137 and onward.

Now, the stage is not in the stage one when the determination in step S108 is negative, or it is determined No. The processor 41 in this case executes the process in step S111 and onward, namely, determines whether to end the automatic lift of the boom 3. Next, there will be described a case where the determination is negative, or it is determined No, in step S109. The second condition is not established in this case so that the automatic lift of the boom 3 is not started. The processor 41 executes the process in step S129 and onward. Now, the stage is not in the stage two when the determination in step S111 is negative, or it is determined No. The processor 41 in this case executes the process in step S114 and onward.

Next, there will be described a case where the determination is negative, or it is determined No, in step S112. The third condition is not established in this case where it is determined that the automatic lift of the boom 3 is not to be ended. In such case, the processor 41 proceeds to step S138. In step S138, the processor 41 determines whether or not the boom control lever 30 is at a neutral position for the duration of a predetermined time "th". The predetermined time "th" in the present embodiment is set to 0.1 seconds but is not to be limited thereto.

When the boom control lever 30 is at the neutral position for the duration of the predetermined time "th" (step S138: Yes), the processor 41 sets an automatic lift command to "h" in step S139. In the present embodiment, "h" is set to 60% but is not to be limited thereto. The boom control lever 30 not being at the neutral position for the duration of the predetermined time "th" (step S138: No) indicates that the boom control lever 30 is operated by the operator of the wheel loader 1. In this case, the processor 41 sets the automatic lift command to 0% in step S140 in order to give priority to the operation by the operator. The processor 41 executes the process in step S129 and onward after setting the automatic lift command in step S139 or step S140.

When the determination is negative, or it is determined No, in step S114, the processor 41 need not determine whether or not the bucket 4 is on stand-by to perform the automatic tilt operation. The processor 41 in this case executes the process in step S118 and onward. The OFF time Δt2 has not elapsed when the determination is negative, or it is determined No, in step S116. In this case as well, the processor 41 executes the process in step S118 and onward.

The processor 41 need not determine whether to start the automatic tilt operation by the bucket 4 when the determination is negative, or it is determined No, in step S118. The processor 41 in this case executes the process in step S121 and onward. When the determination is negative, or it is determined No, in step S119, it is determined that the start condition for the automatic tilt operation by the bucket 4 is not established. The processor 41 in this case executes the process in step S121 and onward.

The automatic tilt operation is not being performed when the determination is negative, or it is determined No, in step S121. The processor 41 in this case executes the process in step S125 and onward. The ON time Δt1 has not elapsed when the determination is negative, or it is determined No, in step S123. In this case as well, the processor 41 executes the process in step S125 and onward.

The end condition for the automatic tilt operation is not being determined when the determination is negative, or it is determined No, in step S125. In this case, the processor 41 executes the process in step S129 and onward without making any determination on the fifth condition. The condition to end the automatic tilt operation is not established when the determination is negative, or it is determined No, in step S126. In this case as well, the processor 41 executes the process in step S129 and onward.

The stage is in the stage zero when the determination is affirmative, or it is determined Yes, in step S129. That is, the automatic excavation control is ended. The excavation by the automatic excavation control is not ended when the determination is negative, or it is determined No, in step S132. In these cases, the processor 41 executes the process in step S134 and onward.

In the present embodiment, the tilt operation of the bucket 4 is started on the basis of the bottom pressure Pb and the vehicle speed, and the automatic tilt operation is ended on the basis of the amount of increase ΔPb of the bottom pressure Pb. This starting and ending of the tilt operation are repeated until the bucket 4 reaches the tilt end. The timing chart in FIG. 7 illustrates that the tilt operation of the bucket 4 starts at times t=t5, t7, and t9 and ends at times t=t6, t8, and t10. Therefore, the processor 41 can imitate the excavation work of the wheel loader 1 operated by the operator by repeating the start/end of the tilt operation of the bucket 4 by means of the automatic excavation control.

The present embodiment is adapted to automatically control the operation of the bucket 4 and the boom 3 in the automatic excavation on the basis of the lifting force applied to the boom 3. Having high correlation with the traction of the wheel loader 1, the lifting force may be used in the automatic excavation control to be able to effectively use the traction of the wheel loader 1 in the excavation. As a result, the present embodiment can maintain the productivity achieved in the excavation work at a high level regardless of the level of proficiency of the operator operating the wheel loader 1.

The present embodiment is in particular adapted to end the tilt operation on the basis of the lifting force of the boom 3 when causing the bucket 4 to perform the tilt operation automatically while the automatic excavation control is being executed. Such processing can reduce an unnecessary operation such as continuing the tilt operation of the bucket 4 at timing when the traction can be used effectively, whereby the present embodiment can maintain the production efficiency achieved in the excavation work at the high level close to that of an expert regardless of the level of proficiency of the operator.

Moreover, the present embodiment is adapted to control the operation of the bucket 4 and the boom 3 automatically in the automatic excavation on the basis of the lifting force applied to the boom 3, and can therefore be flexibly adapted to a different type or quality of the load or a different shape thereof at each site. The present embodiment can therefore improve the production efficiency at the time of the excavation work in the automatic excavation. Furthermore, in the present embodiment, the excavation work performed by an experienced operator need not be stored in a storage device for each site, so that the excavation work can be performed efficiently.

The productivity achieved in the automatic excavation by the wheel loader 1 and the productivity of excavation performed by a manual operation of the wheel loader 1 were compared among expert, mid-level, and novice operators. The productivity of excavating the crushed stones by the manual operation turned out to be 2 tons/second by the expert operator, 1.75 tons/second by the mid-level operator, and 1.4 tons/second by the novice operator. On the other hand, the productivity achieved in the automatic excavation by the wheel loader 1 turned out to be 1.6 tons/second by the expert operator, 1.9 tons/second by the mid-level operator, and 1.8 tons/second by the novice operator. As one can see from the result, the automatic excavation by the wheel loader 1 may be used to realize the productivity close to that achieved by the manual operation by the expert even when the wheel loader is operated by the mid-level and novice operators.

The productivity of excavating the blasted rock by the manual operation turned out to be 3.2 tons/second by the expert operator, 2 tons/second by the mid-level operator, and 1.9 tons/second by the novice operator. On the other hand, the productivity achieved in the automatic excavation by the wheel loader 1 turned out to be 2.3 tons/second by the expert operator, 2.5 tons/second by the mid-level operator, and 2.3 tons/second by the novice operator. As one can see from the result, the automatic excavation by the wheel loader 1 may be used to realize the same level of productivity by all the operators regardless of their levels of proficiency. Moreover, the mid-level and novice operators were able to realize the productivity close to that achieved by the manual operation by the expert.

The present embodiment has been described above but is not to be limited to what has been described. The aforementioned components also include ones that can easily be envisioned by those skilled in the art and ones that are substantially identical or what is called their equivalents. The aforementioned components can also be combined as appropriate. Furthermore, various omissions, substitutions or modifications of the components can be made without departing from the scope of the present embodiment.

REFERENCE SIGNS LIST

1 wheel loader
2 body
3 boom
4 bucket
4B bottom surface
5 work machine
6F front wheel
6R rear wheel
9 boom cylinder
10 bucket cylinder
11 bell crank
12 work machine hydraulic pump
13 boom control valve
14 bucket control valve
15 pilot pump
16 engine
18 transmission
18L selector lever
20 solenoid proportional control valve
21 boom lowering solenoid proportional control valve
22 boom lifting solenoid proportional control valve
23 bucket dump solenoid proportional control valve
24 bucket tilt solenoid proportional control valve
30 boom control lever
32 bucket control lever
34 automatic excavation start switch
35 kick-down switch
40 control device
41 processor
42 storage unit
43 input unit
44 output unit
45 input/output device
46 boom angle detection sensor
47 bucket angle detection sensor
48 boom cylinder pressure sensor
CL control lever
CS control system

The invention claimed is:

1. A work vehicle comprising:
a body;
a boom which is supported by the body and is turned;
a bucket which is supported by a side of the boom opposite to a side of the body and is turned;
a boom driving part which turns the boom;
a bucket driving part which turns the bucket;
a lifting force detector which detects lifting force as force that the boom driving part receives from the boom;
a vehicle speed detector which detects a speed at which the work vehicle runs;
a boom angle detection sensor which detects an angle of the boom; and
a control device configured to start a tilt operation of the bucket when a predetermined condition is established, and end the tilt operation on the basis of an amount of increase of the lifting force from a time when the tilt operation is started, wherein
the control device is configured to start the tilt operation on the basis of at least a detected result from the lifting force detector and a detected result from the vehicle speed detector.

2. The work vehicle according to claim 1, wherein
the boom driving part includes a boom hydraulic cylinder, and
the lifting force detector is a boom bottom pressure detector which detects a bottom pressure as a pressure on a hydraulic fluid supplied to the boom hydraulic cylinder.

3. The work vehicle according to claim 1, wherein the control device starts an ascending operation of the boom on the basis of the lifting force, the speed at which the work vehicle runs, and an angle of the boom, and ends the ascending operation on the basis of an amount of increase of the lifting force or the angle of the boom from the start of the ascending operation of the boom.

4. A method of controlling a work vehicle including a body, a boom which is supported by the body and is turned, and a bucket which is supported by a side of the boom opposite to a side of the body and is turned, the method comprising, in controlling an operation of the bucket of the work vehicle:

starting a tilt operation of the bucket on the basis of at least lifting force as force that a boom driving part which turns the boom receives from the boom and a speed at which the work vehicle runs;

detecting an angle of the boom; and ending, after the tilt operation is started, the tilt operation on the basis of an amount of increase of the lifting force from a time when the tilt operation is started.

5. The method of controlling a work vehicle according to claim 4, wherein an ascending operation of the boom is started on the basis of the lifting force, the speed at which the work vehicle runs, and an angle of the boom, and the ascending operation is ended on the basis of an amount of increase of the lifting force or the angle of the boom from the start of the ascending operation of the boom.

* * * * *